United States Patent [19]

Hasselqvist et al.

[11] 4,069,638

[45] Jan. 24, 1978

[54] STRUCTURE OF LIGHTWEIGHT BARS AND CONNECTOR MEANS THEREFORE

[75] Inventors: Stig Ernst Allan Hasselqvist, Mjolby; Anders Victor Thoreson, Rimforsa, both of Sweden

[73] Assignee: Scanovator AB, Linkoping, Sweden

[21] Appl. No.: 604,150

[22] Filed: Aug. 13, 1975

Related U.S. Application Data

[63] Continuation-in-part of Ser. No. 580,483, May 22, 1975, abandoned.

[30] Foreign Application Priority Data

June 5, 1974 Sweden ..... 7407353

[51] Int. Cl.[2] ..... E04C 3/32

[52] U.S. Cl. ..... 52/726; 52/731; 52/738; 403/231; 403/302; 403/311; 403/312; 403/363

[58] Field of Search ..... 29/184, 185; 403/401, 403/402, 231, 302, 310–312, 363; 52/758 C, 758 D, 758 H, 726, 515, 731, 720, 738, 634, 727; 211/182; 248/244, 246; 428/36

[56] References Cited

U.S. PATENT DOCUMENTS

| | | | |
|---|---|---|---|
| 835,478 | 11/1906 | Sjobring | 52/731 X |
| 910,192 | 1/1909 | Grouvelle et al. | 52/720 X |
| 1,852,146 | 4/1932 | Carns et al. | 52/515 X |
| 2,098,752 | 11/1937 | Miller | 52/731 X |
| 2,185,916 | 1/1940 | Groetschel et al. | 52/720 X |
| 2,508,032 | 5/1950 | Kennedy | 52/731 |
| 2,598,498 | 5/1952 | Brown | 52/515 X |
| 3,134,468 | 5/1964 | Toti et al. | 52/731 |
| 3,396,499 | 8/1968 | Biffani | 52/720 X |
| 3,448,955 | 6/1969 | Fussell | 40/363 X |
| 3,919,603 | 11/1975 | Salvati | 403/363 |

FOREIGN PATENT DOCUMENTS

| | | | |
|---|---|---|---|
| 905,691 | 12/1945 | France | 403/302 |
| 1,110,473 | 7/1961 | Germany | 211/182 |
| 415,385 | 10/1946 | Italy | 52/234 |
| 368,758 | 3/1932 | United Kingdom | 46/29 |
| 956,562 | 4/1964 | United Kingdom | 52/738 |

*Primary Examiner*—Leslie Braun
*Attorney, Agent, or Firm*—Finnegan, Henderson, Farabow & Garrett

[57] ABSTRACT

A lightweight bar comprising a hollow, elongated member having channels within and extending along its faces, said member being composed of sheet material formed into the required configuration of the member and having a pair of edges joined together to close the cross section of the member.

8 Claims, 25 Drawing Figures

FIG. 1
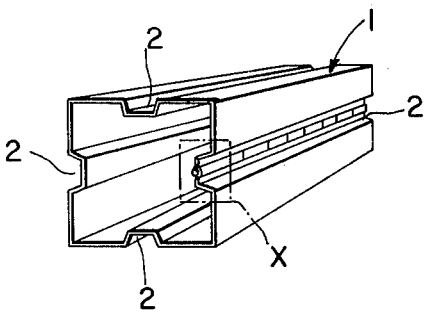
FIG. 2
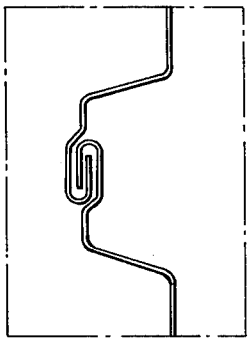
FIG. 3
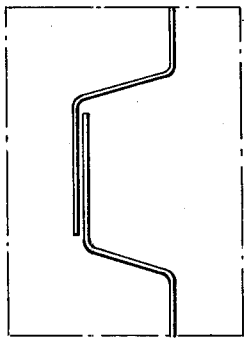
FIG. 4
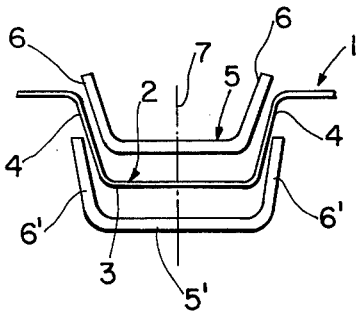
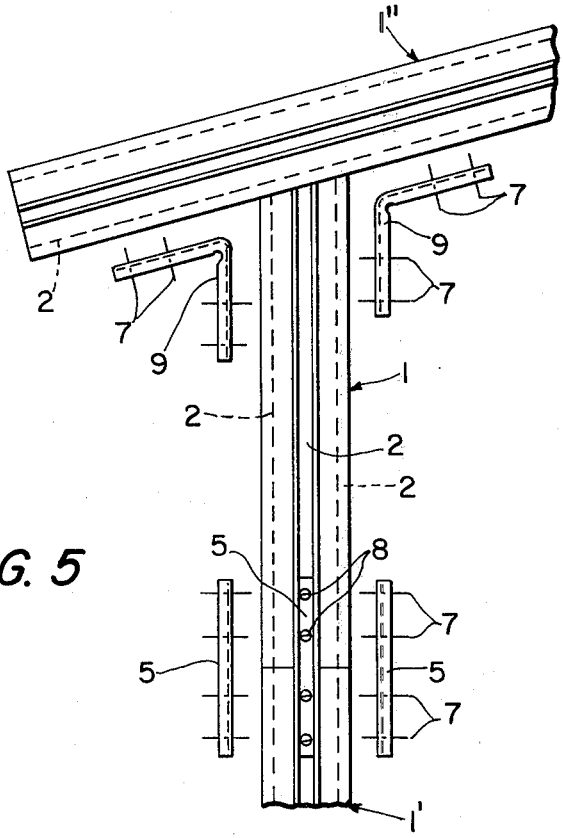
FIG. 5

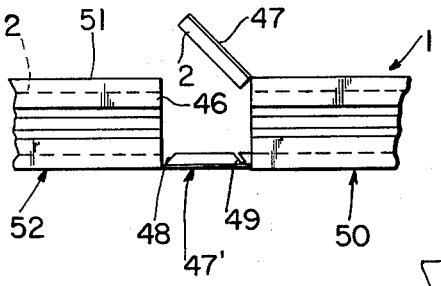
FIG. 22
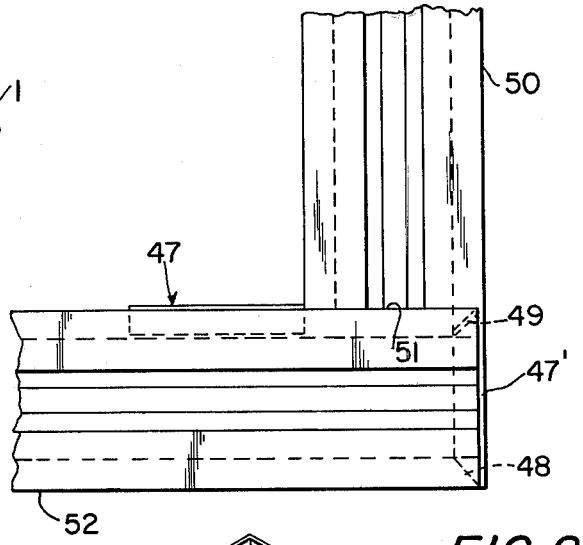
FIG. 23
FIG. 25
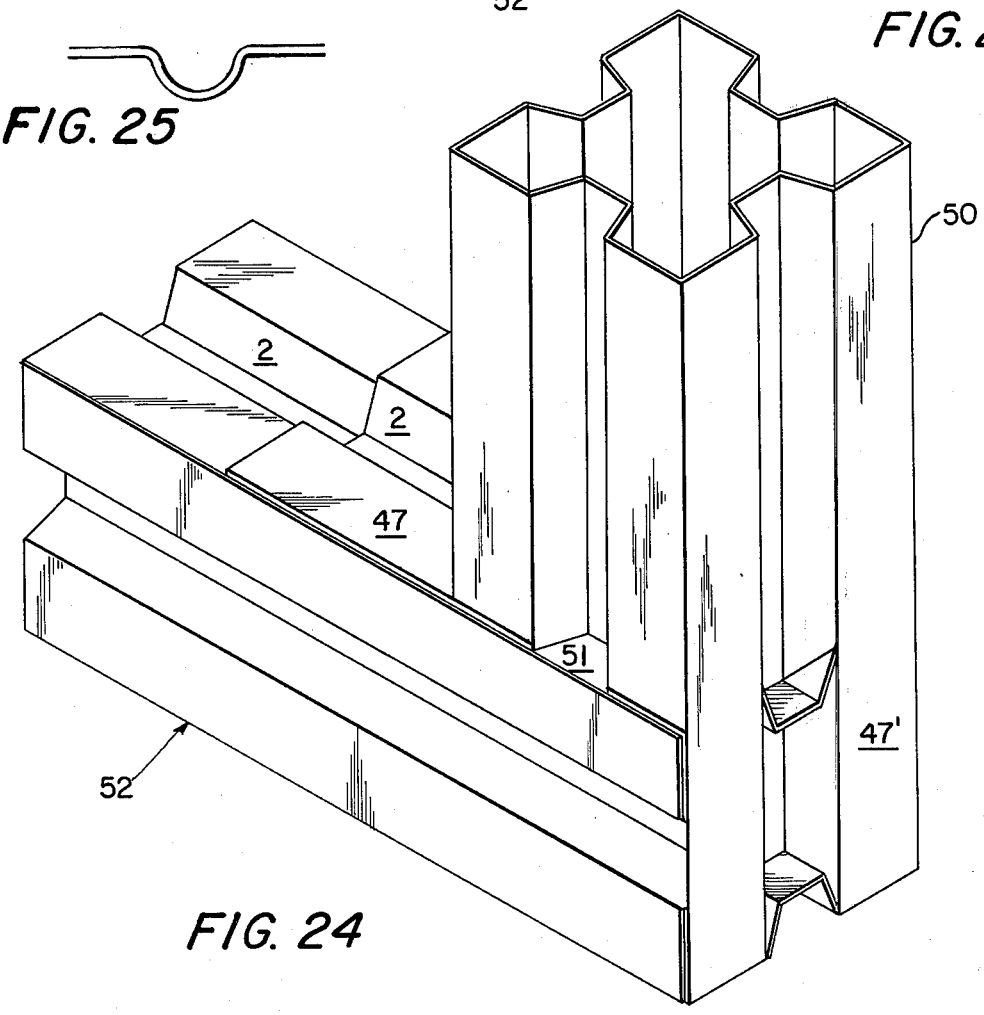
FIG. 24

STRUCTURE OF LIGHTWEIGHT BARS AND CONNECTOR MEANS THEREFORE

This application is a continuation-in-part of Application Ser. No. 580,483, filed May 22, 1975, now abandoned.

This invention relates to hollow, elongated metal members and to the manufacture of same.

Such members are known and are presently manufactured by extrusion or by welding together material to form the desired profile of the member. Both these manufacturing techniques have disadvantages. When the metal is aluminum, extrusion does not allow the walls of the member to be thinner than 2 mm. when the largest transverse cross-sectional dimension of the member is 75 mm. or more. Thin walls are even more difficult to obtain when the metal is steel. In the case of manufacturing techniques involving extrusion or welding, the member in most cases has to be surface-treated.

Accordingly, an object of the present invention is to provide a thin-walled, hollow and elongated structural member which is lightweight and yet has good bending resistance and which is simple to make.

This object is achieved in accordance with the invention in that the member has channels within and extending along its faces and is composed of sheet metal formed into the required configuration of the member and having a pair of edges joined together to close the cross section of the member.

The faces of the member can be curved or planar. A preferred member is of square or rectangular cross section. The member is lightweight, since it is formed from sheet metal, and yet has a high resistance to buckling due to provision of the recesses.

As is more fully described hereinbelow, the channels may serve for the attachment of connectors to enable a framework to be erected from a plurality of the members. If the connectors are not attached to the parts of the faces of the members which are not channelled, which parts, during bending, are subjected to the highest bending stresses, connection together of members by using the channels does not reduce the bending resistance of each individual member. In this case, the connectors may be joined to the members by screws, rivets or welding at the bases of the recesses. Connection together of the members by the channels serves to distribute all types of load, in particular impact loads, torsional loads, bending loads and concentrated loads. It has in fact been determined that when a framework is formed from the present members and is loaded, transmission of loads through the connectors is unexpectedly even and avoids localized overloading for virtually all types of loading.

The invention, therefore, further provides a connector shaped to engage at least one channel within each of a pair of the members.

As mentioned above, the channels provide a high resistance to buckling. If an excessive load is applied so that buckling does occur, a buckle cannot extend right across the member since the channels prevent this. After a certain amount of buckling occurs, the bases of opposite channels contact one another whereupon even a much higher resistance to bending occurs.

Preferably, the connector is shaped to frictionally engage at least one channel within each of a pair of members. For instance, at least one of the channels may comprise a base and a pair of substantially planar sides, the sides being mutually inclined as viewed in transverse cross section such that the width of the channel increases in a direction extending outwardly of the member from the base of the channel. In this case, the connector has a pair of substantially planar sides which are mutually inclined at a slightly different angle than the sides of the channel, the angle of inclination of the sides of the connector being lesser or greater, respectively, than that of the sides of the channel in accordance with whether the connector is intended to engage with the outside of the channel (i.e., from inside the member) or with the inside of the channel (i.e., from outside the member). A frictional fastening thus arises when the connectors are urged into engagement with the channels. As the channels and connectors contact one another over substantial areas, loads are spread out and the connectors are able to transmit considerable loads.

The channels may instead be part circular in transverse cross section and the connectors shaped correspondingly. To ensure frictional engagement, the connectors should be slightly lesser or greater, respectively, in diameter than the channels in accordance with whether they are intended to engage with the outside of the channel (i.e., from inside the member) or with the inside of the channel (i.e., from outside the member).

The employment of a frictional fastening mechanism has the advantage that the rivets, screws or other means used for firmly securing together the members and connectors are not subjected to any substantial shear stresses if the frictional engagement force is not exceeded.

To improve the quality of the connection, the connector may be formed from sheet material, for instance, sheet metal having at least one recessed portion having a pair of substantially planar sides and at least one support portion shaped to engage a part of at least one face of at least one of the members. This construction of the connector has the advantage that it enables a pair of members to be joined at a desired angle in that a cut or groove is formed in the recessed portion of the connector and the connector is bent about the cut or groove to an arbitrary angle equal to the angle at which the members are to be joined.

The invention also provides a method of manufacturing the member that includes the steps of forming the channels in the sheet metal, bending the channelled sheet to form the faces of the member and joining together the pair of edges to close the cross section of the member.

For instance, a length of sheet metal may be cut from a supply thereof and put in a press to form the channels. The channelled plate is then folded to its final profile and its cross section is closed by joining together its edges, preferably at the base of a channel. The edges may be joined by welding, screwing, riveting, gluing or by overlapping and seaming.

Further, the invention provides a method of manufacturing the member in which formation of the channels within the member and formation of the faces of the member are effected by roll-forming.

This method is advantageous in that it enables a high capacity output to be obtained, partly because of the possibility of pretreatment of the sheet metal. For instance, the members can be made from coils of sheet metal which are painted, galvanized, coated with a vinyl plastic or otherwise pretreated. This enables fabrication of members with a large range of desired finishes.

The invention additionally provides a method of forming a bend in the member, the method comprising forming opposite openings across the width of a pair of opposed faces of the member, thereby leaving parts of another pair of opposed faces bridging the openings; separating a first of said parts from the member at a first end of the openings and cutting the channel within the first part at the second end of the openings; bending the first part about an axis defined by the cut within the channel to an angle corresponding to the desired angle of the bend; forming a cut in the channel within the second part at the second end of the openings and bending the member to the required angle of bend about an axis defined by the cut in the channel within the second part; engaging the channel within the first part with the channel within the corresponding face of the portion of the member nearer the first end of the openings; and fixing the engaged channels together.

The invention will now be further described by way of example with reference to the accompanying drawings, in which:

FIG. 1 is a perspective view of a member in accordance with the invention;

FIGS. 2 and 3 are views on a much larger scale of detail X of FIG. 1 and showing alternative ways in which the cross section of the member may be closed;

FIG. 4 is a cross-sectional view through one face of the member shown in FIG. 1 and through two alternative connectors suitable for connecting the member to another like member;

FIG. 5 shows how the member shown in FIG. 1 can be connected to other like members by suitable connectors to form a framework;

FIG. 22 shows how the member shown in FIG. 1 may be modified as a preliminary step in forming a corner or elbow bend therein; and FIGS. 23 and 24 are, respectively, side and perspective views of the modified member of FIG. 22 after it has been bent to form the bend.

FIG. 25 is a cross-sectional view through one face of a member having a channel that is part-circular in transverse cross section.

Throughout the drawings, like reference numerals denote like items.

Figure 6:
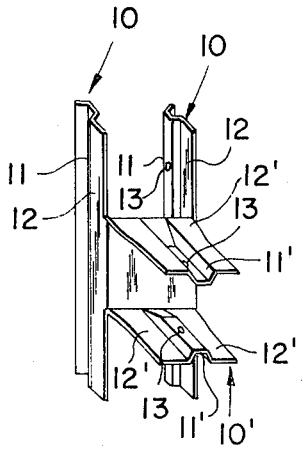
FIG. 6 is a perspective view of a connector.

In accordance with the invention and with reference to FIG. 1, a hollow, elongated, thin-walled metal member 1 is of rectangular shape in transverse cross section and has a channel 2 within and along each face thereof. The member is formed from sheet metal and has two abutting edges joined at the base of the extreme right channel 2 in FIG. 1 to close the cross section of the member. As shown in FIG. 2, these edges may be joined by overlapping and seaming. Alternatively, as shown in FIG. 3, the edges may be simply overlapped and secured together by suitable means (not shown), e.g., by rivets or screws spaced along the length of the member 1 or by an adhesive.

The member 1 is formed from sheet metal which may have been subjected to a finishing process prior to formation of the member. The metal may be steel. In this case, the thickness of the metal may be less than 1 mm. if the largest cross-sectional dimension of the member is 20 mm.; and less than 3 mm. if the largest cross-sectional dimension is 100 mm. Alternatively, the metal may be aluminum in which case the thickness may be less than 0.8 mm. if the largest cross-sectional dimension of the member is 20 mm; and less than 1.8 mm. if the largest cross-sectional dimension is 100 mm. For different metal thicknesses, the values of the largest cross-sectional dimension of the member may vary in proportion to those set forth above.

As shown in FIG. 4, each channel 2 of member 1 has a base 3 and a pair of sides 4 which are mutually inclined such that the width of the channel increases in a direction extending outwardly of the member 1 from the base of the channel.

FIG. 4 also shows two alternative connectors 5, 5' for connecting together a pair of members 1. Both connectors 5, 5' are channel-like members of sheet material, e.g., sheet metal, and have a cross section similar to that of the channels 2. However, the angles included between the sides 6—6 and 6'—6' of the connectors 5 and 5', respectively, are slightly different than the angle included between the sides 4 of the channel 2. The angle included between the sides 6 of the connector 5 is greater than that included between the sides 4 of the channel 2 and the angle included between the sides 6' of the connector 5' is less than that included between the sides 4 of the channel 2. In this way, when the connectors 5, 5' are secured to the base 3 of the channel 2, for instance, by screws (not shown) directed along axes 7, they are urged into tight frictional engagement with the sides 4 of the channel, as was explained hereinabove.

FIG. 5 shows the member 1 secured to two like members 1', 1'' by a plurality of connectors. The member 1 is joined end to end with the member 1' by straight connectors 5, the screws 8 securing one of the connectors 5 to the bases of two aligned channels in the members 1 and 1" being visible. The member 1 is joined to the member 1" by a pair of connectors 9 which are the same as the connectors 5, except that they are bent to the appropriate angles.

Figure 7:
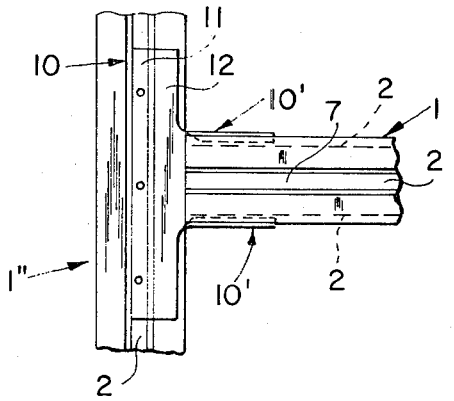
FIG. 7 shows a pair of members connected together by the connector shown in FIG. 6.

FIG. 6 shows an alternative connector for connecting together at right angles a pair of members 1, 1", as shown in FIG. 7. The connector comprises a pair of opposed limbs 10 each of which comprises a recessed portion 11 formed like the connectors 5 and a support portion 12. In use, each recessed portion 11 is frictionally engaged with and secured to one of the pair of opposed channels 2 of the member 1", and the support portions 12 engage the faces of the member 1" having these channels. The connector further comprises a pair of limbs 10', each having a recessed portion 11' formed like the connectors 5 and two support portions 12'. In use, each recessed portion 11' is frictionally engaged with and secured to one of the opposed channels 2 of the member 1, and the support portions 12' engage the faces of the member 1 having these channels. Holes 13 are provided in the bases of the recessed portions 11 and 11' for receiving screws or rivets to secure the connector to the bases of the channels.

Figure 8:
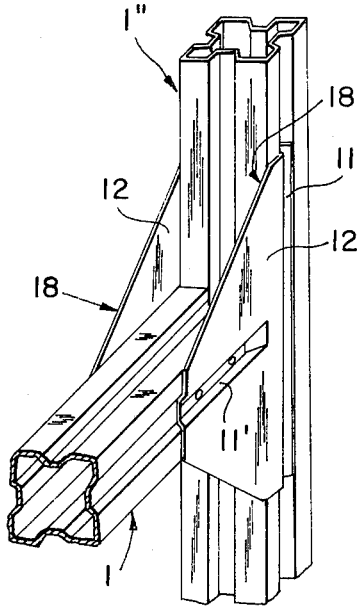
FIG. 8 is a perspective view of a pair of members connected at right angles by a pair of connectors.

FIG. 8 shows how a pair of connectors 18 can be used to effect a right-angled joint between a pair of members 1, 1". This arrangement provides a stiff joint particularly suited to withstand bending moments.

Figure 9:
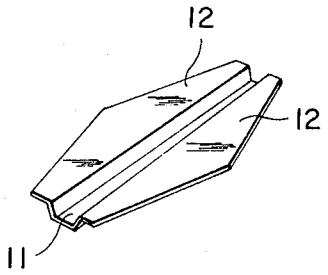
FIG. 9 is a perspective view of a further connector.
Figure 10:
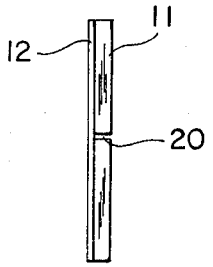
FIG. 10 is a side view of the connector of FIG. 9 showing a cut made in a recessed portion thereof.
Figure 11:
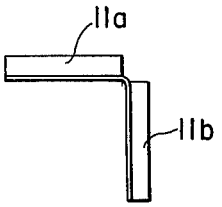
FIGS. 11 and 12 are, respectively, side and perspective views of the connector of FIG. 9 after it has been bent through 90° about the cut shown in FIG. 10.
Figure 12:
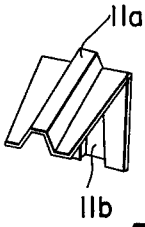

FIG. 9 shows a further connector also having a recessed portion 11 and two support portions 12. The connector can be used as shown to effect end-to-end joints like the connectors 5 in FIG. 5. However, as will now be described, the connector can readily be adapted to make angled joints, for instance, like the connectors 9 in FIG. 5. For instance, a cut 20 can be made with a hacksaw in the recessed portion 11, but not in the support portions 12, as shown in FIG. 10. The connector is then bent, for instance, through 90° to adopt the configuration shown in FIGS. 11 and 12, whereupon it can be used to connect a pair of members at right angles, the parts **11*a* and 11*b* of the recessed portion 11** defined by the bending operation entering channels within the respective members.

Figure 13:
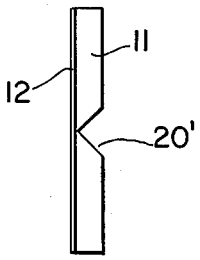
FIG. 13 is a view similar to FIG. 10, but showing the connector with a larger, V-shaped cut or groove.
Figure 14:
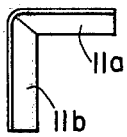
FIG. 14 is a side view of the connector of FIG. 13 after it has been bent through 90° about the cut in a sense opposite to the direction of bending in the case of FIGS. 11 and 12.

If a larger cut 20' in the form of a V-shaped groove is made, as shown in FIG. 13, the recess can be bent in the opposite direction through 90° to adopt the configuration shown in FIG. 14.

Naturally, the connector of FIG. 9 can be bent to an arbitrary angle; the above description of bending it at right angles is given by way of example only.

Figure 15:
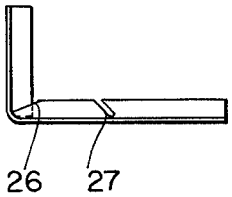
FIG. 15 is a view corresponding to FIG. 14 and showing how the connector of FIG. 9 can be modified to form a connector for the outside of a right-angled corner or elbow joint between two members.

FIG. 15 shows how the connector of FIG. 9 can be modified to form a connector for the outside of a right-angled corner or elbow joint between two members. In this case, two parts 26, 27 of the recessed portion 11 are removed entirely and the connector is bent through 90° about one end of the cut-away part 26 to adopt a configuration similar to that shown in FIG. 14.

Figure 16:
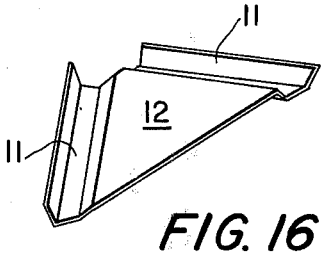
FIG. 16 is a perspective view of a further connector for connecting two members at right angles.

FIG. 16 shows yet a further connector having two recessed portions 11 for joining a pair of members at right angles, and a support portion 12.

Figure 17:
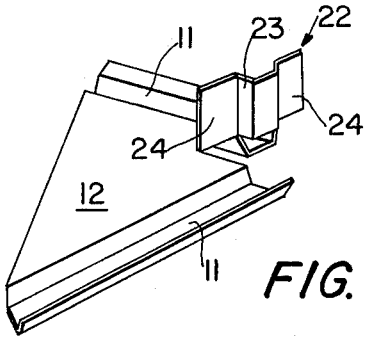
FIG. 17 is a perspective view of a connector similar to that shown in FIG. 16, but modified to enable connection of three orthogonal members.

FIG. 17 shows a connector similar to that shown in FIG. 16, but modified to connect three members together orthogonally in the formation of a three-dimensional framework. As can be seen, a part 22 of the end of one of the recessed portions 11 near the apex of the two portions 11 is partially cut away from the connector and bent through 90° to form a recessed portion 23 and support portions 24 at right angles to the plane of the rest of the connector.

Figure 20:
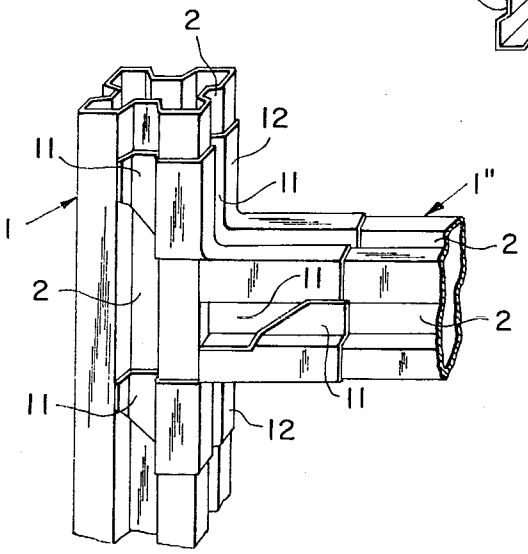
FIG. 20 shows a right-angled joint between two members formed by a connector arrangement similar to that described with reference to FIGS. 18 and 19.
Figure 18:
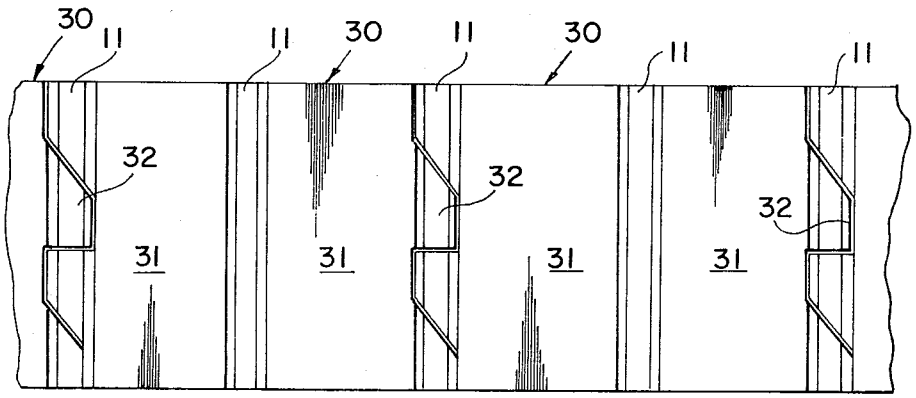
FIG. 18 shows a series of further connectors as they are formed from coil or strip stock.
Figure 19:
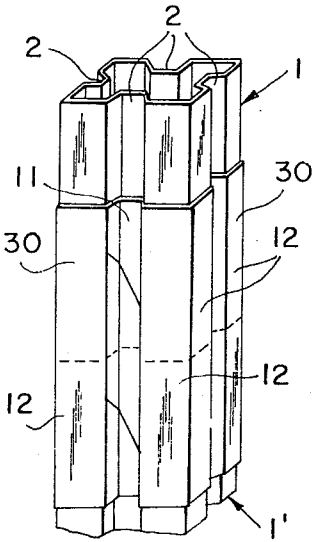
FIG. 19 shows an end-to-end joint between two members formed by a pair of the connectors shown in FIG. 18 after bending of the connectors.

FIG. 18 shows a series of connectors 30 as they are formed from coil or strip stock prior to their being bent. The connectors have recessed portions 11, flat portions 31, and are mutually separated by non-linear edges 32. After the connectors 30 have been bent to form support portions 12 from the flat portions 31, a pair of them may be used to form an end-to-end joint between a pair of members 1, 1', as shown in FIG. 19. This form of connection arrangement is very secure since it encircles the entire joint. A similar arrangement can be used to form a right-angled joint, as is shown in FIG. 20.

Figure 21:
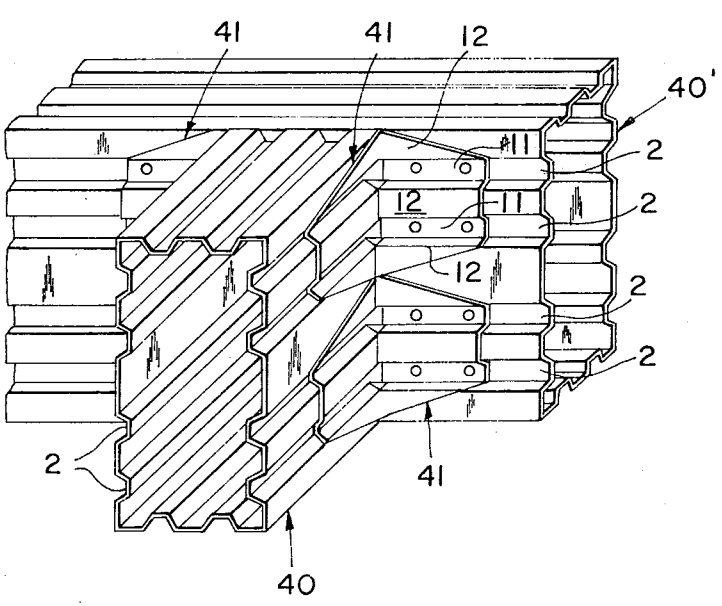
FIG. 21 is a perspective view of a right-angled joint between a pair of members each having a plurality of channels within and along each of their faces.

FIG. 21 shows how a right-angled joint may be effected between a pair of members 40, 40', each having a plurality of channels 2 within and along each of their faces. A plurality of channels within each face is used for large members. The members 40, 40' are connected together by four connectors 41, three of which can be seen in the drawings. The connectors 41 again have the recessed portions 11 and support portions 12.

With reference to FIGS. 22–24, there will now be described a method of forming a corner or elbow bend in the member 1. A pair of rectangular openings 46, one of which is visible in FIG. 22, are formed opposite one another across the entire width of the member. The openings are of a length equal to the width of the bar that extends vertically in FIG. 22.

Formation of the openings leaves two parts 47, 47' of the other pair of opposite faces bridging the gap formed by the openings. One part 47 is separated from the member at its left-hand end, as viewed in FIG. 22, and at its other end has a cut formed through the channel 2 but not through the face of the member 1 having this channel. The part 47 is bent through 90° about an axis defined by the art.

The other part 47' has cuts 48 and 49 formed in its channel 2 only at its opposite ends. The whole member 1 is then bent through 90° about the bottom of the cut 48 so that a part 50 of the member to the right of the openings, as viewed in FIG. 22, rests on a face 51 of a part 52 of the member to the left of the openings. The channel 2 within the part 47 then engages within and is suitably secured to the channel within the face 51 of the part 52 of the member 1, thus forming the required joint. The completed joint is shown in perspective in FIG. 24.

What is claimed is:

1. A structure comprising:

a. a first hollow, elongated member having a plurality of faces, composed of a single piece of sheet metal having its longitudinal edges joined together to close the cross-section of said member, each of said faces having a longitudinally extending channel, at least one of said channels comprising a base and a pair of substantially planar sides, said sides being mutually inclined as viewed in transverse cross-section such that the width of the channel increases in a direction extending outwardly of said member from the base of said channel;

b. a second hollow, elongated member having faces and channels as in said first member; and c. a connector connecting together said first and second members, said connector comprising a base of substantially the same width as the base of said one of said channels and a pair of substantially planar sides which are mutually inclined at a slightly different angle than the sides of said channel, said connector's planar sides frictionally engaging at least one channel in each of said first and second members.

2. The structure of claim 1, in which at least one of the channels is part-circular in transverse cross section.

3. The structure of claim 1, wherein said connector is formed from sheet material having at least one recessed portion having the pair of substantially planar sides and at least one support portion engaging a part of at least one face of at least one of the members.

4. The structure of claim 1, wherein said edges are joined together within a channel.

5. The structure of claim 1, wherein said sides of said connector are inclined at an angle less than the angle of inclination of said sides of said channels and said connector engages the outside of said channels.

6. The structure of claim 1, wherein said sides of said connector are inclined at an angle greater than the angle of inclination of said sides of said channels and said connector engages the inside of said channels.

7. The structure of claim 1, further comprising additional means for positively attaching said connector to said members, said additional means engaging said members only in said channels.

8. The structure of claim 1, wherein said first and second hollow, elongated members each have four faces and the channel in each face has substantially the same configuration.

* * * * *